US006264348B1

(12) United States Patent
Ellis

(10) Patent No.: US 6,264,348 B1
(45) Date of Patent: Jul. 24, 2001

(54) DIFFUSER MOUNTING MECHANISM

(75) Inventor: Elliot J. Ellis, Northridge, CA (US)

(73) Assignee: Prudential Lighting Corporation, Los Angeles, CA (US)

( * ) Notice: Subject to any disclaimer, the term of this patent is extended or adjusted under 35 U.S.C. 154(b) by 0 days.

(21) Appl. No.: 09/516,312

(22) Filed: Mar. 1, 2000

Related U.S. Application Data

(60) Provisional application No. 60/129,005, filed on Apr. 13, 1999.

(51) Int. Cl.[7] ..... F21V 17/00

(52) U.S. Cl. ..... 362/375; 362/374; 362/260; 362/311; 362/223

(58) Field of Search ..... 362/365, 374, 362/375, 260, 311, 223, 457

(56) References Cited

U.S. PATENT DOCUMENTS 3,525,544 * 8/1970 Jacobs ..... 292/18

* cited by examiner

*Primary Examiner*—Sandra O'Shea
*Assistant Examiner*—Ali Alavi
(74) *Attorney, Agent, or Firm*—Christie, Parker & Hale, LLP

(57) ABSTRACT

A mounting mechanism is provided for attaching a diffuser to a fluorescent lighting fixture. The mounting mechanism is coupled to the diffuser and includes an elongated latch member and an elongated second member. Each member of the mechanism is pivotally coupled to an end of the diffuser in a spaced apart relationship. The members are coupled to each other via a spring connected to each member below the member's pivotal point. The second member may also be a latch member of may be a hinge member. Each latch member penetrates a notch formed through the housing socket plate and latches on an upper surface of the socket plate. Each hinge member includes a hook portion having a tip. The hook portion penetrates a first notch formed on the socket plate in a first direction while the tip portion penetrates a second opening adjacent the first opening in a second direction opposite the first direction thereby hooking on the socket plate.

24 Claims, 9 Drawing Sheets

DIFFUSER MOUNTING MECHANISM

CROSS-REFERENCE TO RELATED APPLICATION

This application claims priority and is based on Provisional Application No. 60/129,005, filed Apr. 13, 1999, and fully incorporated herein by reference.

FIELD OF THE INVENTION

This invention relates to mounting mechanisms and specifically to mechanisms for mounting diffusers to fluorescent lighting fixtures.

BACKGROUND OF THE INVENTION

Fluorescent lighting fixtures typically have a plastic diffuser (i.e., lens) attached to the fixture housing so as to enclose the fluorescent lighting tubes and to diffuse the light in the most advantageous manner. When the diffuser is in place, the fluorescent lighting tubes, ballast, fixture wires as well as any starter units, are entirely enclosed within the fixture. These fixtures are normally provided with mounting mechanisms for mounting the diffuser to the housing. Typically a mounting mechanism is attached at each end of the diffuser. A mounting mechanism consists of a pair hinges pivotally mounted in a spaced apart relationship at an end of the diffuser. The bottoms of the hinges are coupled to each other via a spring. A hook extends from the top portions of the hinges.

The problem with current hooked hinges is that they sometimes "hook" onto wires located in the housing making disengagement of the hooks from the housing difficult. Moreover, sometimes the fixture wires block the upward movement of the hooks preventing them from disengaging from the openings. Furthermore, hooks hook onto the socket plate and as consequence require that the diffuser is lifted during dismounting to free the hooks from the socket plate. As such, a mechanism is desired that would allow for easy mounting and dismounting of the diffuser from the fixture housing, preclude the hooking of any wires in the housing and eliminate the requirement of lifting of the diffuser for complete dismounting.

SUMMARY OF THE INVENTION

Accordingly, the present invention provides a mounting apparatus for attaching a diffuser to a fluorescent lighting fixture so that the diffuser may be easily removed entirely from the housing or may be hinged along a longitudinal axis of the housing providing access to the enclosed components. When hinged, the present invention provides means for preventing the diffuser from being accidentally disengaged from the housing when in the open position.

In one embodiment, the present invention provides a combination latch and hinge mounting mechanism which is simple in operation and economical in construction. In an alternate embodiment, the present invention provides a latch and latch mechanism. The latches in this mechanism engage the socket plates of a fixture without hooking on to them. Consequently, lifting of the diffuser is not required for disengaging the latches.

These and other attendant advantages of this invention will be readily appreciated as the same become better understood by reference to the following detailed description considered in connection with the accompanying drawings.

DETAILED DESCRIPTION OF THE INVENTION

Figure 1A:
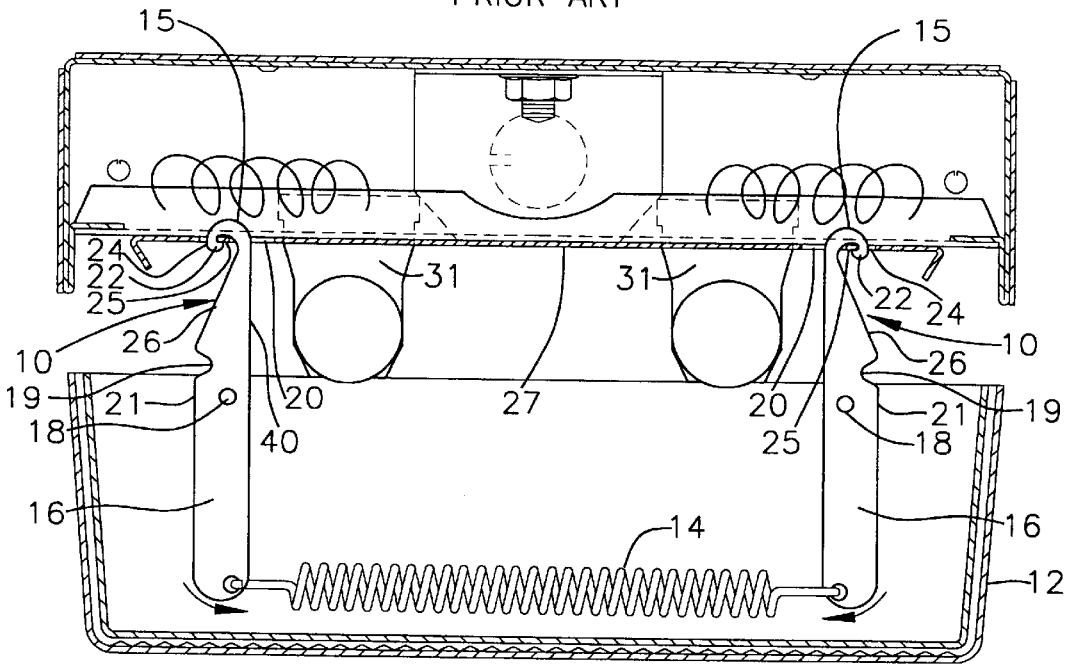
FIG. 1A PRIOR ART
FIG. 1A is a front sectional view of a hinge mounting mechanism with the diffuser secured in an intermediate position on a fluorescent fixture according to the prior art.

The prior art diffuser mounting or hinge mechanisms (i.e., apparatus) consist of two spaced apart hinges 10, each pivotally mounted on an end of the diffuser 12 (FIG. 1A). Each prior art mechanism consists of a spring 14 coupled to the bottom portions 16 of the two hinges below their pivoting points 18. A hook 15 is formed at the upper end of each hinge in each mechanism. The two hinge hooks within each mechanism face outwardly away from each other. Moreover, a notch 19, referred to herein for convenience as a lock notch, is formed on the external edge 21 of each hinge above the pivot point 18 of each hinge. A mounting mechanism is attached to each end of the diffuser. Consequently, the hinges of each mounting mechanism are pivotally mounted to an end of a diffuser.

Figure 2:
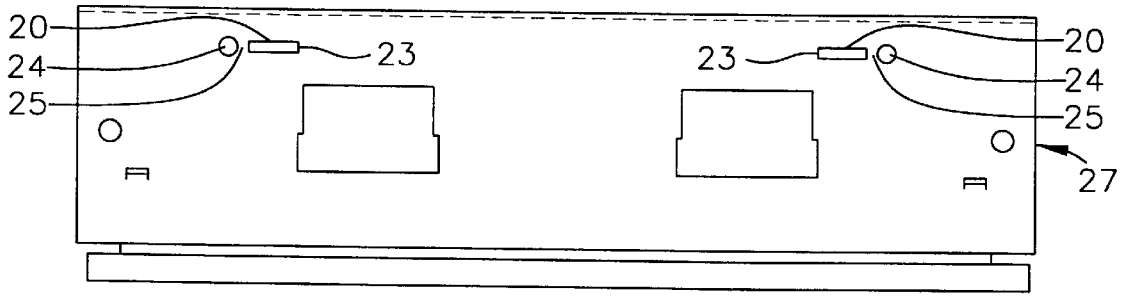
FIG. 2 PRIOR ART
FIG. 2 is a plan view of a socket plate.
Figure 1B:
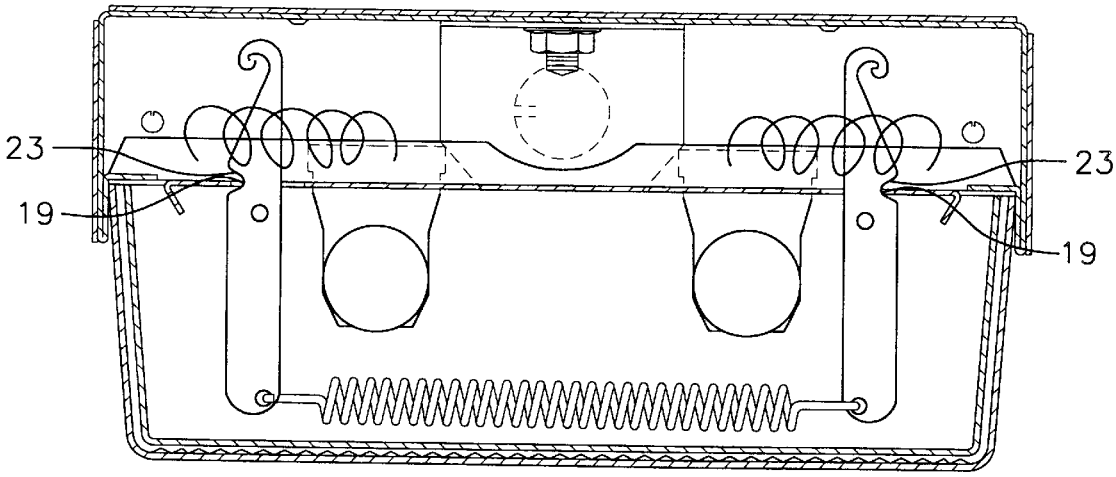
FIG. 1B is a front sectional view of the hinge mounting mechanism with diffuser shown in FIG. 1A secured in a fully mounted position.

To mount the diffuser onto the fixture housing, the top portions of the hinges of each mechanism are pushed toward each other (i.e., the bottom portions are moved outward) so as to pivot the hinges to a position to allow the hooks of the hinges to be fitted through corresponding slots 20 formed on the fixture housing socket plates 27 (FIG. 2) by lifting the diffuser upward toward the fixture. The top portions 26 of the hinges are then allowed to pivot away from each other by the force of the spring pulling the bottom portions of the hinges toward each other causing the tips 22 of the hooks to extend over openings 24 formed adjacent to the slots 20 on the socket plate. A bridge 25 is defined between the slot 20 and adjacent opening 24. The tips of the hooks penetrate these openings as the diffuser is allowed to drop. Consequently, the hooks hook around the bridge, thereby hooking the diffuser to the socket plate and thus the housing as shown in FIG. 1. The diffuser is then pushed upward. As the diffuser continues upward the spring 4 urges the lower portions of the hinges within each mechanism toward each other and the diffuser is secured against the fixture housing when the lock notch 19 at each hinge engages an edge 23 of its corresponding slot 20 as shown in FIG. 1B.

Figure 3:
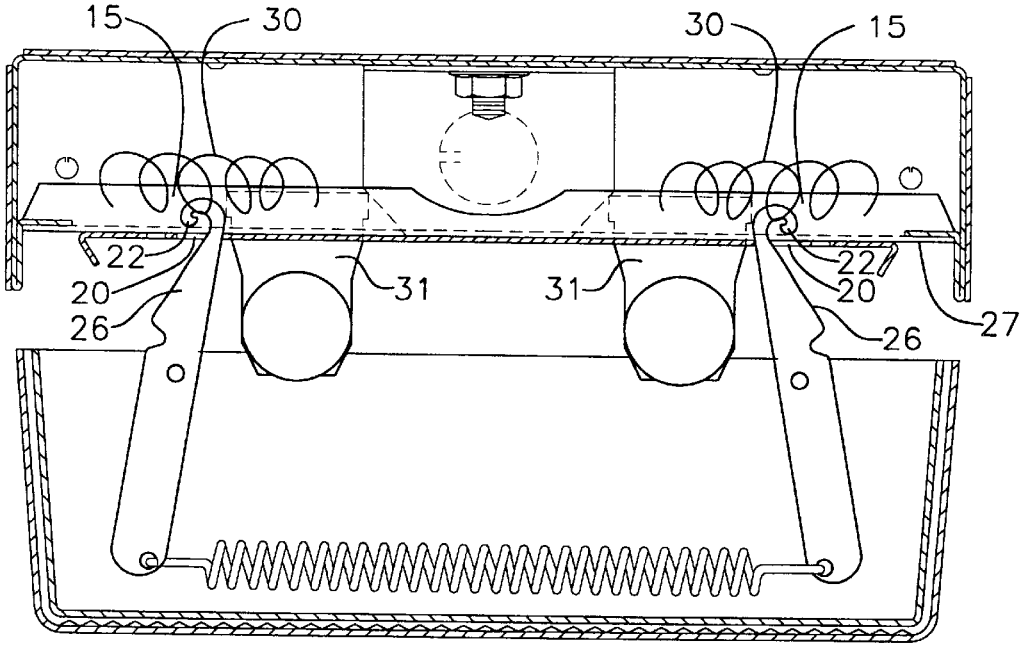
FIG. 3 is a front sectional view of the mechanism of FIG. 1 with the diffuser lifted in an intermediate position.

To dismount the diffuser, the diffuser is pulled downward forcing the upper portions of the hinges toward each other as the notches 19 on the hinges slide past the slot edges 23. The hooks of the hinges then hook around their corresponding bridges 25 on the socket plate. To fully dismount the diffuser, the diffuser is lifted so as to disengage the hook tips from the openings 24. The top portions 26 of the hinges are then moved toward each other orienting the hinges with their corresponding slots 20 as shown in FIG. 3. The hook 15 of each hinge is then allowed to fall through its corresponding slot 20 in the socket plate. Lifting the diffuser causes a wider part of the hinge to penetrate the slot making it more difficult to rotate the top portions of the hinges toward each other.

With the prior art hinge mechanisms, the fixture wires 30 running from the ballast to the sockets 31 often impede or prevent the hinge from achieving the required vertical position for disengagement. Moreover, during installation or removal of the diffuser, the hooks many times hook on the wires making removal of the diffuser difficult. Furthermore, the hooked wires may prevent the hook tips 22 from penetrating the openings 24 formed adjacent to the slots for properly "hooking" onto the bridge 25. In addition, the diffuser must be lifted to fully disengage the hooks from the socket plate.

Figure 4A:
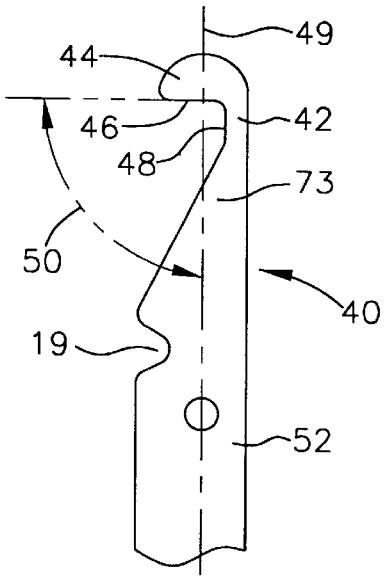
FIG. 4A is a side view of an elongated latch member.

The mounting systems of the present inventions overcome these problems. In a first embodiment, an improvement over the prior art mechanisms is provided by using a latch 40 instead of a hinge in each mechanism (FIG. 4A). If one latch is used in each mechanism at each end of the diffuser, the latches should be oriented along the same side of the diffuser.

It should be noted that the terms "upper", "lower", "top", and "bottom" are used as relative terms throughout the specification for conveniently distinguishing various elements of the invention and are not meant to denote the actual spatial position of the elements. For example, an upper portion may be located below a lower portion.

The inventive latch comprises a neck portion 42 from which extends a head 44 having a relatively flat bottom edge 46 that intersects an edge 48 of the neck. The neck is narrower than the body 52 of the latch. The head 44 and its bottom edge 46 bottom edge extend transversely beyond the neck 42. The head bottom edge 46 is preferably approximately perpendicular to the edge 48 of the neck. In a preferred embodiment, the head bottom edge is also approximately perpendicular to the latch central longitudinal axis 49. However, the angle 50 from the relatively flat bottom edge 46 of the head to the longitudinal axis 49 as measured away from the head 44 can be any angle not less than 90° and less than 180°. In this regard, a hook is not created between the head and the neck which can accidentally hook on the fixture wires.

Figure 4B:
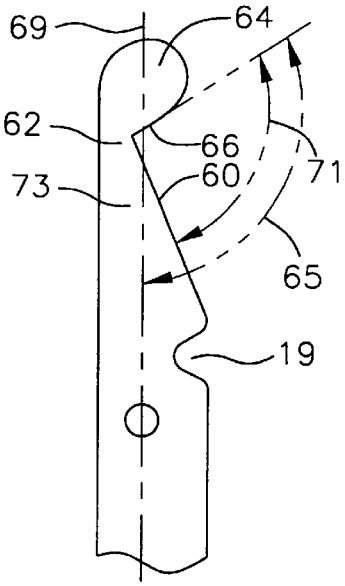
FIG. 4B is a side view of another embodiment elongated latch member.
Figure 4C:
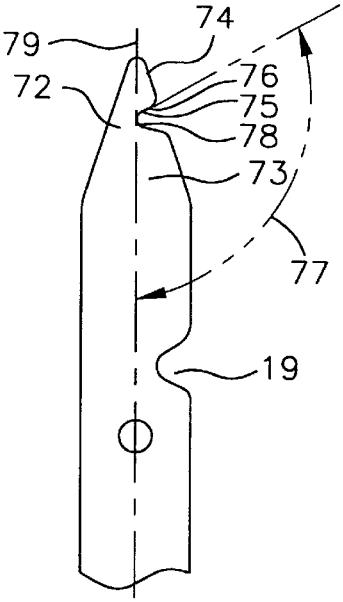
FIG. 4C is a side view of another embodiment elongated latch member.

Another embodiment latch is shown in FIG. 4B. With this embodiment latch, the head 64 has a relatively bottom edge 66 which forms an angle 65 greater than 90° with the longitudinal axis 69 of the latch. A neck portion 62 is defined below the head portion 64. The angle 71 from head bottom edge 66 to the neck edge 68 as measured away from the head 64 is also greater than 90°. A yet further embodiment latch is shown in FIG. 4C. This embodiment latch member consists of a notch 78 on the upper portion of the latch member. A head 74 having a relatively flat bottom edge 76 is defined over the notch 78 such that the notch upper edge 75 defines the bottom edge 76 of the head 74. A neck portion 72 is defined below the bottom edge 76. The angle 77 from the notch bottom edge 76 and the central axis 79 of the latch as measured away from the head 74 is not less than 900. In preferred embodiments, the bottom edges 46, 66 and 76 of the heads are substantially flat.

Figure 5A:
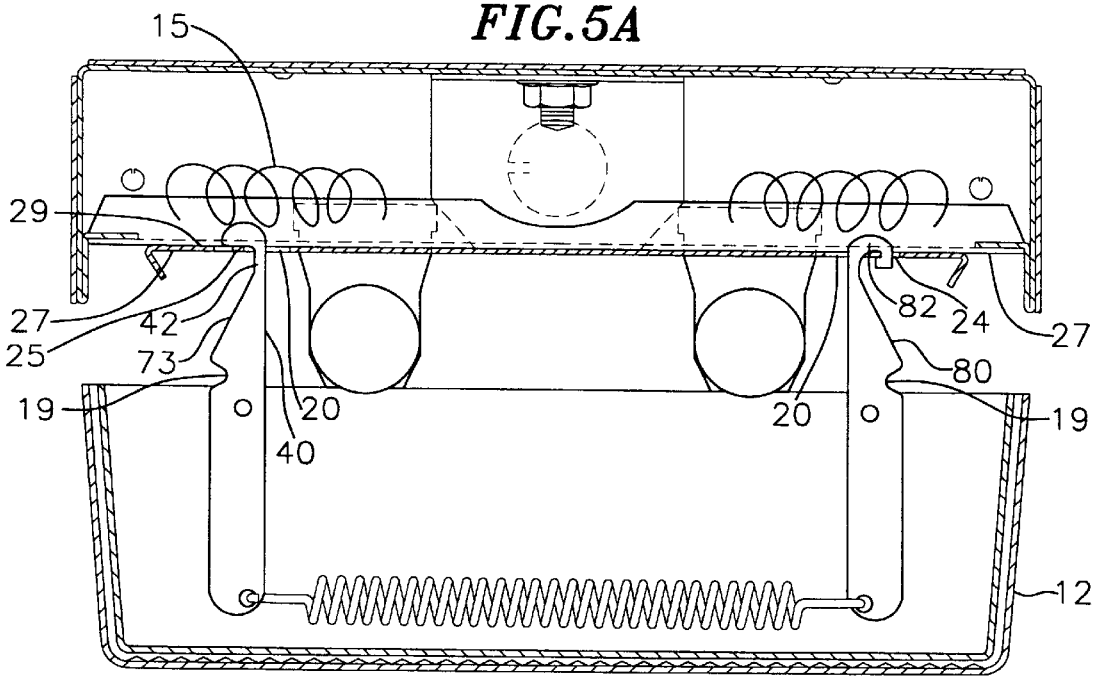
FIG. 5A is a front sectional view of a mounting mechanism of the present invention with the diffuser secured in an intermediate position on the fluorescent fixture.

To engage the latch to the fixture, the latch is rotated to align the head 44, 64, 74 with a corresponding slot 20 on the socket plate 27 of the housing fixture. The head 44, 64, 74 is then moved through the slot in the fixture by lifting the diffuser toward the fixture. The latch is then released and the spring force rotates the latch as for example shown by arrow 51 in FIG. 5A such that the neck 42, 62, 72 moves across the slot 20 such that the bottom edge 46 of the head engages the upper surface 29 of the socket plate 27 (FIG. 5A). The spring force causes the head to maintain engagement with the fixture. The diffuser is then lifted to its final installed position where the lock notch 19 formed on each latch member upper portion engages the bridge 25 on the socket plate so as to lock the diffuser onto the housing.

Figure 5B:
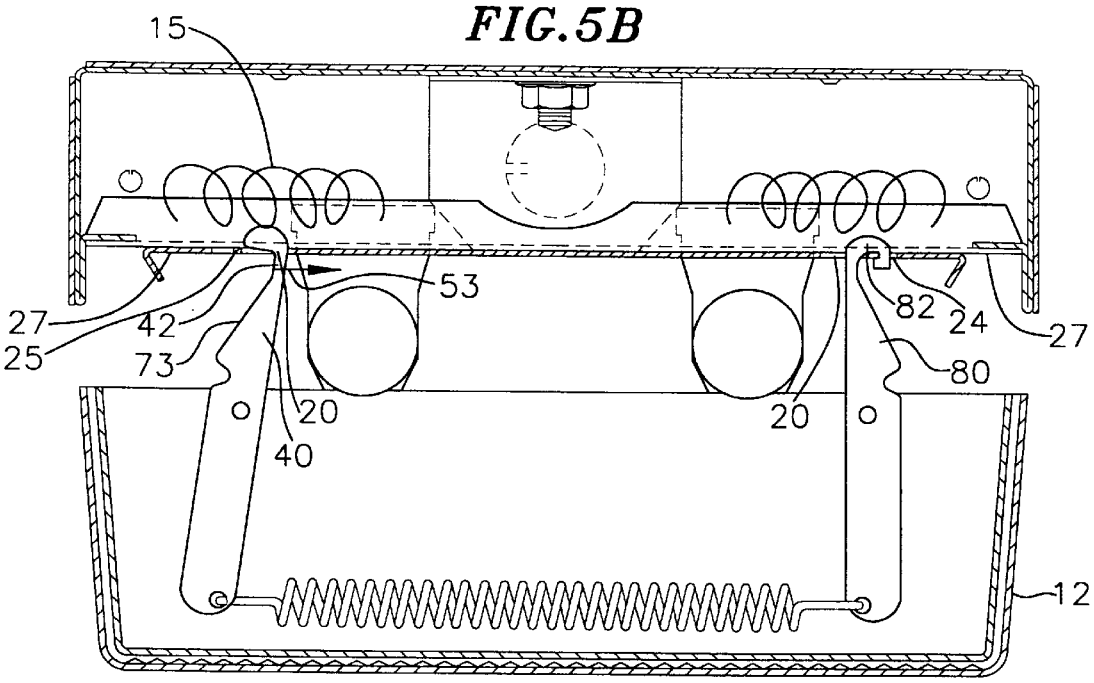
FIG. 5B is a front sectional view of the mounting mechanism shown in FIG. 5A, with latch member of the apparatus moved to a position for disengagement.

Because, the head 44, 64, 74 of the latch does not form a hook, it will not hook on the fixture wires 15. If the head were to engage the wires, disengagement can be easily accomplished by pivoting the head as necessary. While for proper functioning the latch only requires that a single slot or opening, e.g., slot 20, is formed on the socket plate of the fixture, the latch can be used with existing socket plates which have an opening 24 adjacent to each slot such as opening 24 shown in FIG. 2. In such cases, at least a portion of the bottom edge 46, 66, 76 of the latch head will seat on the top surface of the bridge 25 formed between the slot and the opening and will not penetrate the opening adjacent to the slot as shown in FIG. 5A. As a result, the latch would not "hook" on the fixture socket plate 27. Consequently, the latch can be easily released from the fixture by pushing the upper portion 73 of the latch inward as shown by arrow 53 in FIG. 5B until the head is aligned with its corresponding slot 20. The head is then allowed to fall through its corresponding slot. In this regard, the diffuser does not have to be lifted to disengage the latch.

Figure 5D:
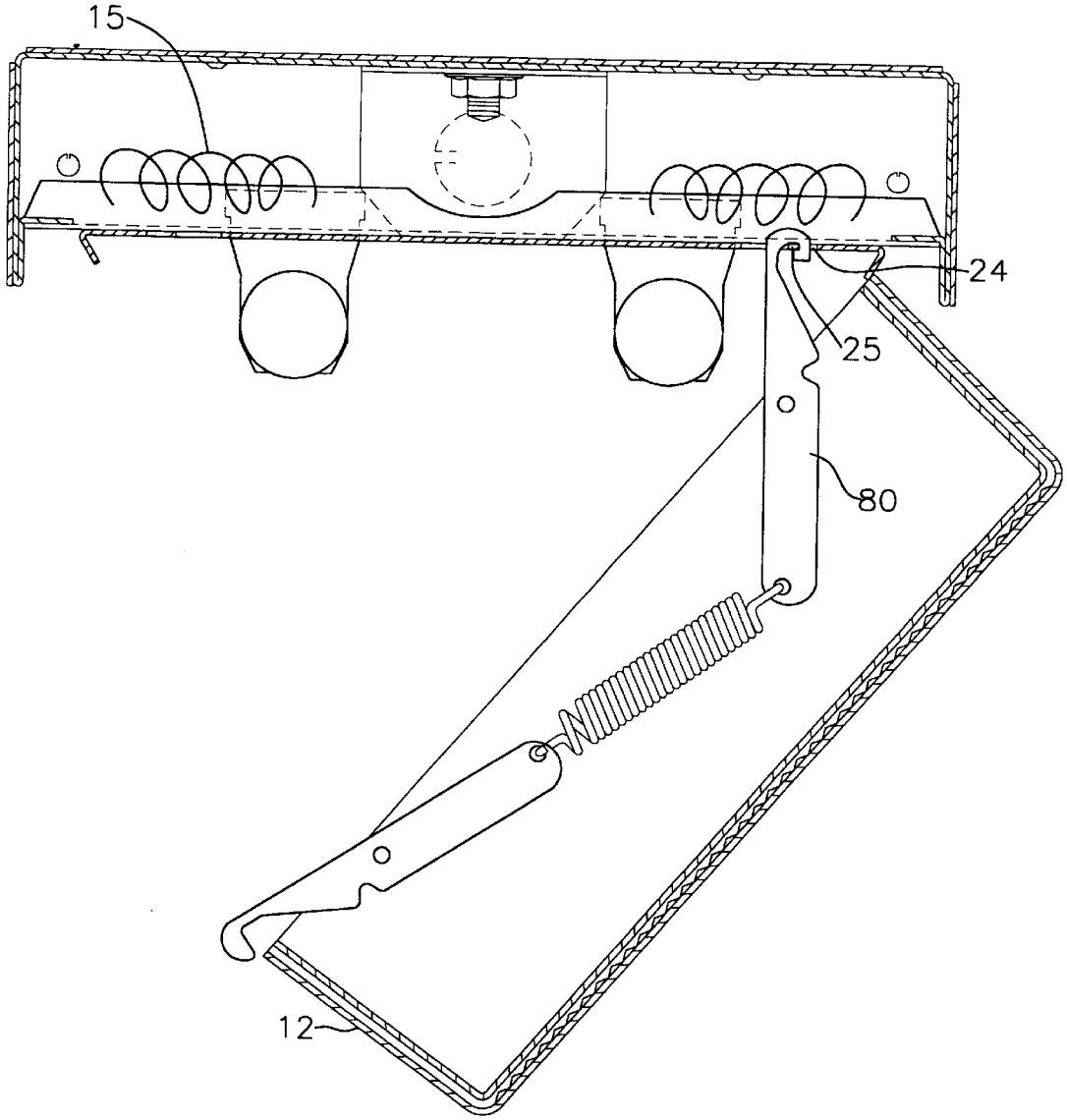
FIG. 5D is a front sectional view of the mounting mechanism of FIG. 5A, with the latch disengaged and the diffuser hinged away from the fixture.
Figure 6:
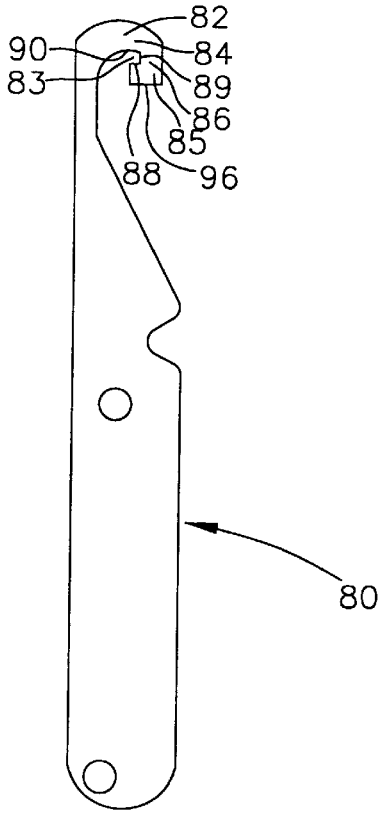
FIG. 6 is a side view of a hinge or hooked latch member of the present invention.

The mounting mechanism of the present invention may comprise a latch and a hinge 80 as shown in FIG. 5A. The hinge has a hook portion 82 extending from its upper end (FIG. 6). When used with conventional fixture housings, the hook portion hooks on the bridge 25 formed on the socket plates of the fixture between the slot 20 and an opening 24. The latch of each mechanism at either end of the diffuser may be easily disengaged from the housing by pushing the latch upper portions 73 toward their corresponding hinges as shown by arrow 53 in FIG. 5B so as to bring their heads over their corresponding slots 20 on the fixture socket plate. The heads are allowed to drop through their corresponding slots. By coupling the latches on the same side of each diffuser head, disengagement of the latches will disengage that side of the diffuser from the fixture. The other side of the diffuser will remain hooked on the diffuser by the hinges 80 as shown in FIG. 5D. In this regard, access is provided to the fluorescent tubes, ballast and wiring without completely removing the diffuser. Moreover, reinstallation of the diffuser only requires that the latches are rotated so that their heads can penetrate their corresponding slots.

To prevent accidental disengagement of the hook 82 of the hinge 80 from the socket plate, the hook 82 forms a channel 83 (as shown in FIG.6) for snugly accommodating a bridge 25 of the socket plate. The hook has an outwardly extending portion 84. A downward portion 86 extends from the end of the outwardly extending portion. A return 85 extends from the end of the downward portion. The inner edges of the outward, downward and return portions define the channel 83. The inner edge 88 of the return is flat for interfacing with the lower surface of the bridge 25. The inner edge 89 of the downward portion is also flat and perpendicular with the inner edge 88 of the return for interfacing with the edge of the bridge defined by the opening 24. The inner edge 90 of the outwardly extending portion is curved for engaging a portion of the bridge upper surface. Once the bridge is engaged by the three edges, rotation of the hook is prevented in an inward direction, i.e., the direction that the weight of the diffuser would attempt to rotate the hook when only one side of the diffuser is hingeably hanging from the housing as shown for example in FIG. 5D.

Figure 5C:
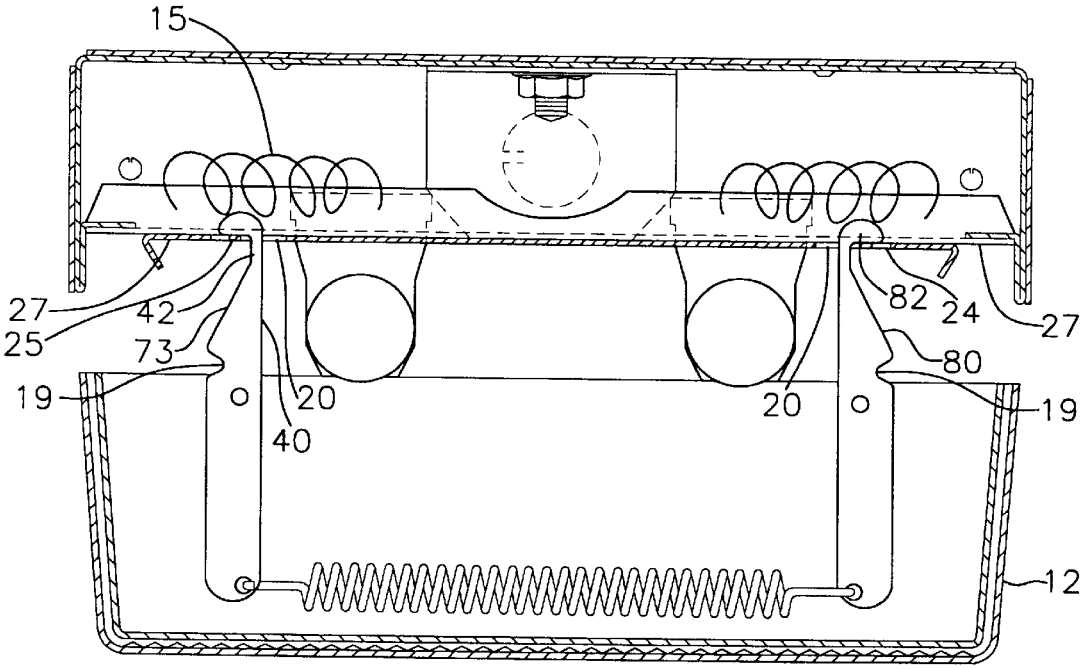
FIG. 5C is a front sectional view of another embodiment mounting mechanism of the present invention comprising two latches.

In an alternate embodiment, a mounting mechanism may incorporate two latches simplifying the mounting and removal of the diffuser (FIG.5C). With this embodiment, the heads of the latches extend opposite each other in an outwardly direction.

Figure 7:
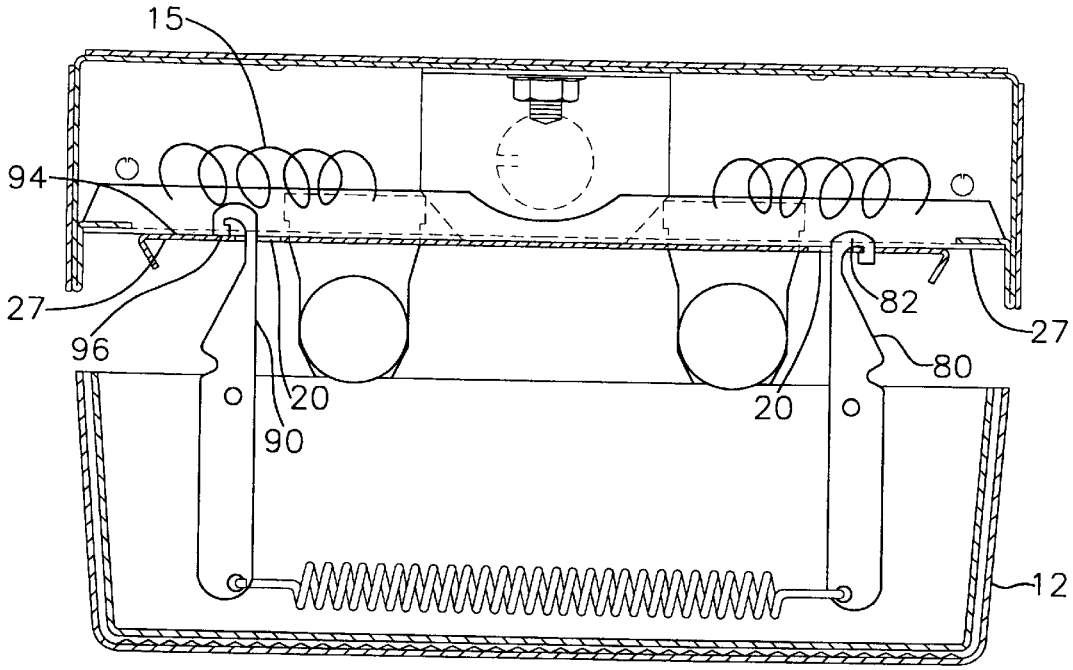
FIG. 7 is a front sectional view of another embodiment mounting mechanism of the present invention comprising a hooked latch member and a hinge.
Figure 8:
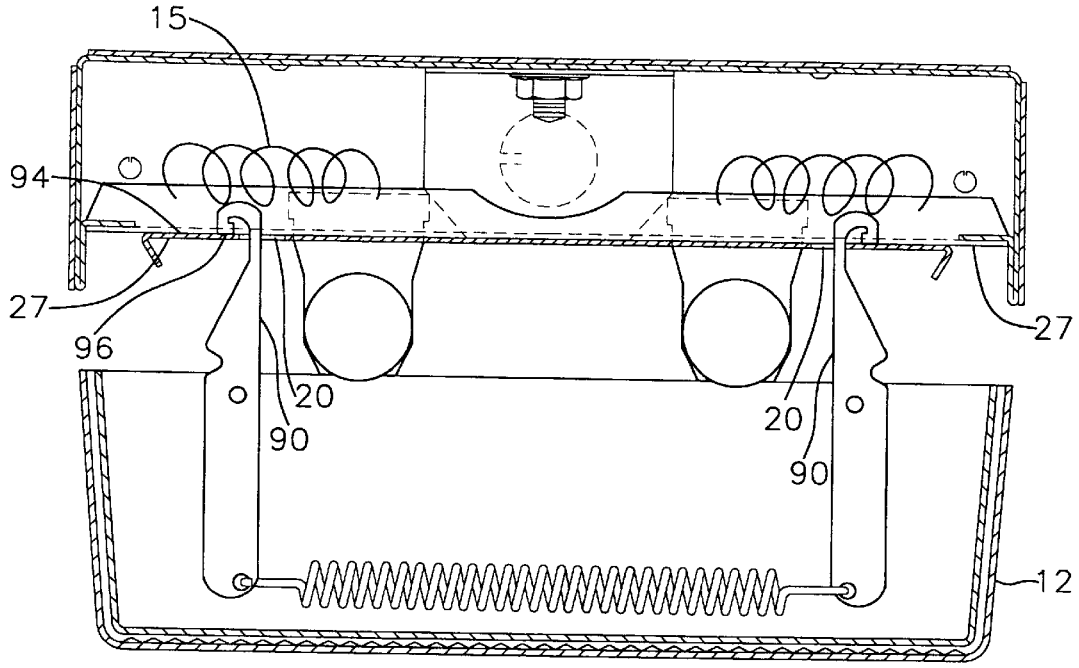
FIG. 8 is a front sectional view of an alternate embodiment mounting mechanism of the present invention comprising two hooked latch members.
Figure 9:
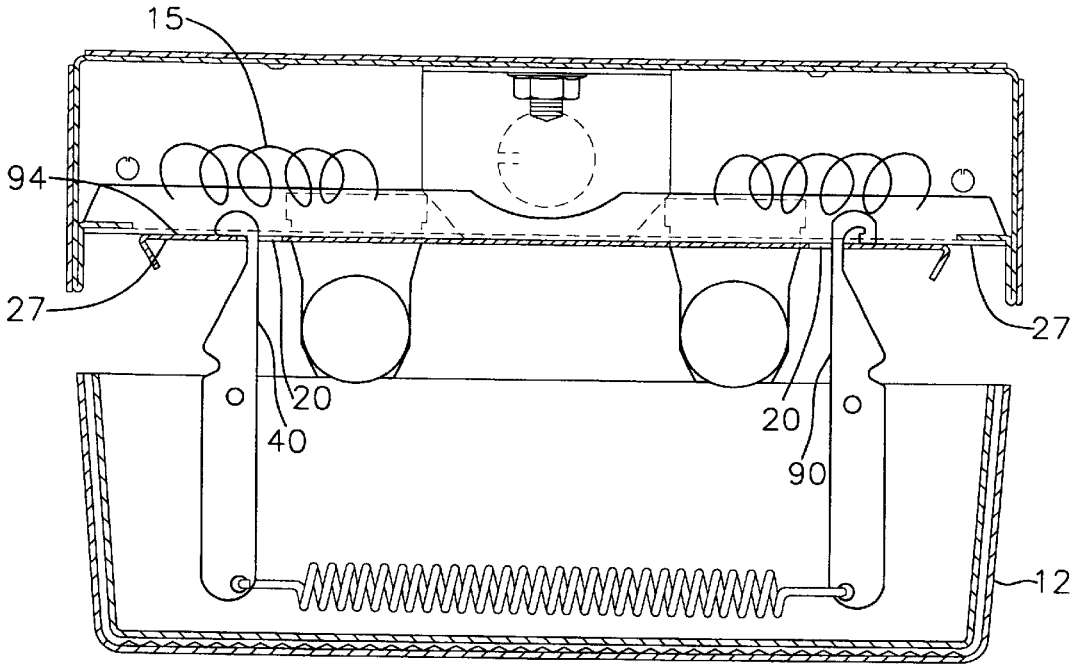
FIG. 9 is a front sectional view of an alternate embodiment mounting mechanism of the present invention comprising a latch member and a hooked latch member.

In a further embodiment mounting mechanism, a hooked latch member is used having a hook extending from its upper end instead of a head. This member can be the same as the hinge member 80 shown in FIG. 6. To allow the hooked member 90 to act as a latch, a single slot or opening (e.g., slot 20) is formed on the socket plate corresponding to the hooked latch. If an opening exists adjacent to the slot it may have to be plugged as necessary to prevent the hook latch from hooking onto the socket plate. To attach the diffuser to the housing, the member is rotated against the spring force so that its hook is aligned with the slot 20 (or opening). The hook is moved through the slot 20 on the fixture socket plate 27. The member is then released causing the hook to rotate outward and the tip of the hook to move over and engage the upper surface 94 of the fixture socket plate as shown in FIG. 7. The hook tip return 85 should have a lower edge 96 for resting flat against the upper surface of the socket plate when in a locking position. In a preferred embodiment, the hook tip has a flat lower edge 96 approximately perpendicular to the member longitudinal axis for engaging the upper surface 94 of the socket plate. In alternate embodiments, a mounting mechanism may incorporate a pair of hooked latches (FIG. 8), or may incorporate a latch and a hooked latch (FIG. 9), or a hinge and a hooked latch (FIG. 7).

For convenience, the present invention diffuser mounting mechanisms have been described for engaging a socket plate at each end of the fixture. However, the present invention mounting mechanisms are not limited to use with socket plates at each end of the fixture. For example, all the mounting mechanisms of a diffuser can latch or hook on to a single plate spanning a portion or the entire fixture or they can latch or hook onto a bracket or multiple brackets or to a wall connected to or integral the fixture. As such, the term "socket plate" as used herein should be construed to mean any structure connected or integral to the fixture onto which the mounting mechanisms of the present invention can latch and/or hook upon.

Figure 10:
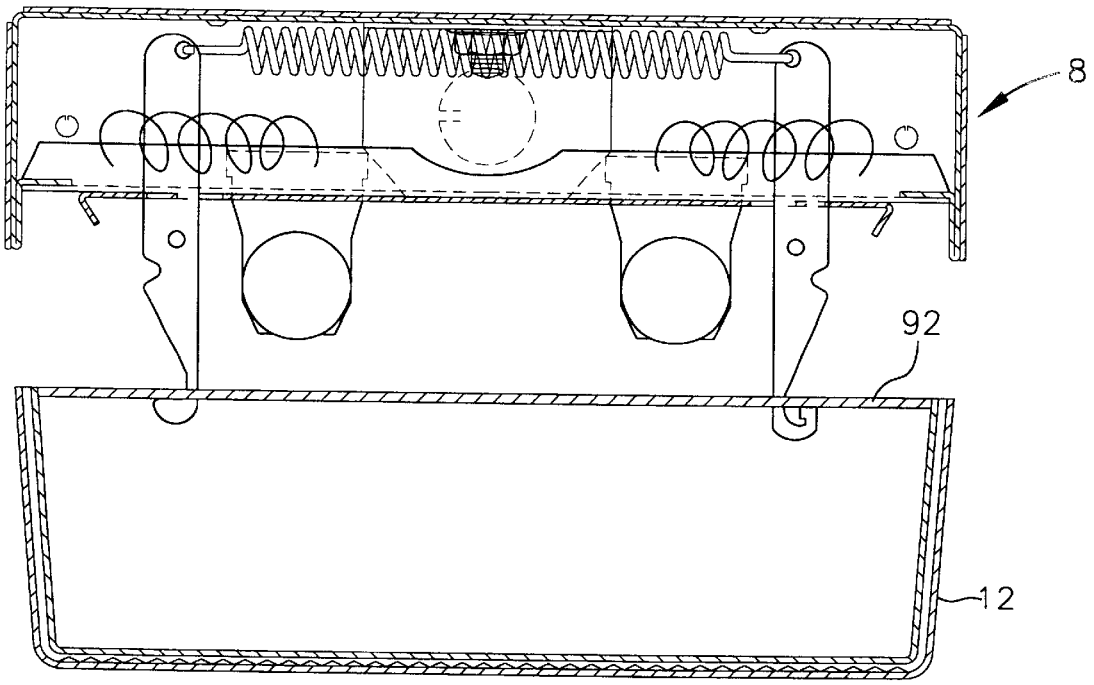
FIG. 10 is a front sectional view of an alternate embodiment mounting mechanism coupled to the fixture housing and engaging the diffuser.

In alternate embodiments, the hook and/or latch members described herein are pivotally coupled to the fixture housing 8 as shown in FIG. 10 and engage the diffusers. With these embodiments, the diffuser is provided with a plate structure 92 that has openings to accommodate the members.

What is claimed is:

1. A mounting apparatus for attaching a diffuser to a lighting fixture housing having a socket plate having an upper and lower surface, the apparatus comprising:

a diffuser;

an elongated latch member pivotally coupled to an end of the diffuser and comprising, an upper portion above the pivotal axis, a lower portion below the pivotal axis, a longitudinal axis extending from the lower portion to the upper portion and through the pivotal axis of said member, and a head extending from the latch member upper end, the head having a transversely extending relatively flat lower edge for penetrating a first opening through the socket plate and being positioned adjacent to the upper surface of the socket plate, wherein the angle between the lower edge and the longitudinal axis as measured from the lower edge and away from the head is not less than 90°;

an elongated hinge member pivotally coupled to said end of the diffuser in a spaced apart relationship with the latch member and comprising, an upper portion above the pivotal axis, a lower portion below the pivotal axis, a longitudinal axis extending from the lower portion to the upper portion and through the pivotal axis of said member, and a hook-shaped portion extending from the hinge member upper portion for penetrating a second opening through the socket plate, the hook-shaped portion comprising a tip for penetrating a third opening adjacent the second opening through the socket plate; and a spring interconnecting the lower portion of each latch member for urging said upper ends of said two members away from each other.

2. An apparatus as recited in claim 1 wherein the latch member comprises a notch formed in the upper portion of the latch member, wherein a portion of said notch forms the transversely extending lower edge of said head.

3. An apparatus as recited in claim 1 wherein the hook-shaped portion of the hinge member comprises:

a portion extending away from the hinge member; and a return portion extending toward the hinge member, wherein the return portion has an inner edge, the inner edge being approximately perpendicular to the hinge member longitudinal axis.

4. An apparatus as recited in claim 1 wherein the latch member head lower edge is approximately perpendicular to the longitudinal axis.

5. An apparatus as recited in claims 1 wherein said latch and hinge member each comprise a notch for engaging the socket plate.

6. A mounting apparatus for attaching a diffuser to a lighting fixture housing having a socket plate having an upper and lower surface and openings therebetween, the apparatus comprising:

a diffuser;

an elongated latch member pivotally coupled to an end of the diffuser about a pivotal axis and comprising, an upper portion above the pivotal axis, a lower portion below the pivotal axis, a longitudinal axis extending from the lower portion to the upper portion and through the pivotal axis of said member, and a head extending from the latch member upper end, the head having a transversely extending relatively flat lower edge for penetrating a first opening through the socket plate and being positioned adjacent the upper surface of the socket plate, wherein the angle between lower edge and the longitudinal axis as measured from the lower edge and away from the head is not less than 90°;

an elongated second member pivotally coupled to said end of the diffuser in a spaced apart relationship with the latch member and comprising, an upper portion above the pivotal axis, a lower portion below the pivotal axis, and a top portion extending outwardly from the upper portion; and a spring interconnecting the lower portions of each latch member for urging said upper ends of said two members away from each other.

7. An apparatus as recited in claim 6 wherein the latch member comprises a notch formed in the upper portion of the latch member, wherein a portion of said notch forms the transversely extending lower edge of said head.

8. An apparatus as recited in claim 6 wherein the elongated second member is an elongate latch member and wherein the top portion is a head extending from the upper portion of said second member for latching against an upper surface of the socket plate, wherein the head comprises a bottom edge, wherein the angle between the bottom edge and a longitudinal axis of the second member as measured from the second member bottom edge and away from the second member head is not less than 90°, and wherein the head of the first latch member and the head of the second latch member extend in opposite directions.

9. An apparatus as recited in claim 6 wherein the elongated second member is an elongated latch member and wherein the top portion is a hook-shaped portion extending from the second member upper end for penetrating a second opening formed through the socket plate, the hook-shaped portion comprising a tip portion for latching on an upper surface of the socket plate.

10. An apparatus as recited in claim 9 wherein the tip portion comprises a lower edge approximately perpendicular to a longitudinal axis of the second member.

11. An apparatus as recited in claim 6 wherein the elongated second member is an elongated hinge member comprising a hook-shaped portion extending from the hinge member upper portion for penetrating a second opening formed through the socket plate, the hook-shaped portion comprising a tip for penetrating a third opening formed through the socket plate adjacent the second opening.

12. An apparatus as recited in claim 11 wherein the hook-shaped portion of the hinge member comprises:

a first portion extending away from the hinge member;

a second portion extending downward from the first portion; and a return portion extending from the second portion toward the hinge member, wherein the return portion has an inner edge, said inner edge being approximately perpendicular to a longitudinal axis of the hinge member.

13. A mounting apparatus for attaching a diffuser to a lighting fixture housing, comprising:

a bracket for coupling to an end of a diffuser;

an elongated latch member pivotally coupled to the bracket and comprising, an upper portion above the pivotal axis, a lower portion below the pivotal axis, a longitudinal axis extending from the lower portion to the upper portion and through the pivotal axis of said member, and a head extending from the latch member upper end, having a relatively flat lower edge transversely extending beyond the latch member upper portion, wherein the angle between the lower edge and the longitudinal axis as measured from the lower edge and away from the head is not less than 90°;

an elongated second member pivotally coupled to the bracket in a spaced apart relationship with the latch member and comprising, an upper portion above the pivotal axis, a lower portion below the pivotal axis, and a top portion extending from the upper portion; and a spring interconnecting the lower portion of each latch member for urging said upper ends of said two members away from each other.

14. An apparatus as recited in claim 13 wherein the latch member comprises a notch formed in the upper portion of the latch member wherein a portion of said notch forms the transversely extending lower edge of said head.

15. An apparatus as recited in claim 13 wherein the elongated second member is an elongate latch member and wherein the top portion is a head extending from the upper portion of said second member, wherein the head comprises a bottom edge, wherein the angle between the bottom edge and a longitudinal axis of the second member as measured from the second member bottom edge and away from the second member head is not less than 90°, wherein the head of the first latch member and the head of the second member extend in opposite directions.

16. An apparatus as recited in claim 13 wherein the elongated second member top portion is a hook-shaped portion extending from the second member upper end, the hook-shaped portion comprising a tip portion.

17. An apparatus as recited in claim 16 wherein the tip portion comprises a lower edge approximately perpendicular to the longitudinal axis.

18. An apparatus as recited in claim 16 wherein the hook-shaped portion of the hinge member comprises:

a first portion extending away from the second member;

a second portion extending downward from the first portion; and a return portion extending from the second portion toward the second member, wherein the return portion has an inner edge, the inner edge being approximately perpendicular to the hinge member longitudinal axis.

19. A fluorescent light fixture comprising:

a fixture housing having a socket plate having an upper surface opposite a lower surface;

a socket extending below the housing for supporting at least one fluorescent tube; and a diffuser mounted on the housing, the diffuser having opposite ends and comprising a mounting mechanism at each end, each mechanism comprising, an elongated latch member pivotally coupled to an end of the diffuser and comprising, an upper portion above the pivotal axis, a lower portion below the pivotal axis, a longitudinal axis extending from the lower portion to the upper portion and through the pivotal axis of said member, and an elongated second member pivotally coupled to said end of the diffuser in a spaced apart relationship with the latch member and comprising, an upper portion above the pivotal axis, a lower portion below the pivotal axis, and a top portion extending outwardly from the upper portion and having a relatively flat lower edge extending outwardly relative to the upper portion; and a spring interconnecting the lower portions of each latch member for urging said upper ends of said two members away from each other.

20. A fixture as recited in claim 19 wherein the lower edge of the top portion extends approximately perpendicular to the longitudinal axis.

21. A fixture as recited in claim 19 wherein the elongated second member is an elongated latch member and wherein the top portion is a hook-shaped portion extending from the second member upper end for penetrating an opening formed through the socket plate, the hook-shaped portion comprising a tip portion having said relatively flat edge.

22. A fixture as recited in claim 21 wherein the hook-shaped portion comprises:

a first portion extending away from the hinge member;

a second portion extending downward from the first portion; and a return portion extending from the second portion toward the hinge member, wherein the return portion has an inner edge, the inner edge being approximately perpendicular to the hinge member longitudinal axis .

23. A fluorescent light fixture comprising:

a fixture housing having a socket plate having an upper surface opposite a lower surface;

a socket extending below the housing for supporting at least one fluorescent tube, the socket plate having an upper surface opposite a lower surface; and a diffuser mounted on the housing, the diffuser having opposite ends and comprising a mounting mechanism at each end, each mechanism comprising, an elongated hinge member pivotally coupled to an end of the diffuser, the elongated hinge member comprising a top portion extending from the hinge member upper end for penetrating a first opening in the socket plate from the lower surface of the socket plate, the top portion comprising, a first portion extending away from the hinge member, a second portion extending downward from the first portion, and a return portion extending from the second portion toward the second member for penetrating a second opening from the upper surface of the socket plate, said second opening being formed on the socket plate adjacent to the first opening, wherein the return portion has an inner edge, the inner edge being approximately perpendicular to the hinge member longitudinal axis, and an elongated second member pivotally coupled to the diffuser in a spaced apart relationship with the latch member and comprising, an upper portion above the pivotal axis, a lower portion below the pivotal axis, and a top portion extending outwardly from the upper portion, and a spring interconnecting the lower portions of each latch member for urging said upper ends of said two members away from each other.

24. A fixture as recited in claim 23 wherein the top portion further comprises a relatively flat lower edge spaced opposite the inner edge.

* * * * *